US008248000B2

(12) United States Patent
Liu

(10) Patent No.: US 8,248,000 B2
(45) Date of Patent: Aug. 21, 2012

(54) LIGHT EMITTING DEVICE DRIVER CIRCUIT, LIGHT EMITTING DEVICE ARRAY CONTROLLER AND CONTROL METHOD THEREOF

(75) Inventor: Jing-Meng Liu, Zhubei (TW)

(73) Assignee: Richtek Technology Corporation, R.O.C., Hsin-Chu (TW)

( * ) Notice: Subject to any disclaimer, the term of this patent is extended or adjusted under 35 U.S.C. 154(b) by 287 days.

(21) Appl. No.: 12/787,574

(22) Filed: May 26, 2010

(65) Prior Publication Data

US 2010/0301760 A1 Dec. 2, 2010

Related U.S. Application Data

(60) Provisional application No. 61/183,366, filed on Jun. 2, 2009.

(51) Int. Cl.
*H05B 37/02* (2006.01)

(52) U.S. Cl. ..... 315/307; 315/185 R; 315/186

(58) Field of Classification Search ..... 315/185 R, 315/186, 193, 291, 294, 297, 307, 308, 312
See application file for complete search history.

(56) References Cited

U.S. PATENT DOCUMENTS

| | | | | |
|---|---|---|---|---|
| 7,375,472 | B2 * | 5/2008 | Wong et al. | 315/307 |
| 8,072,153 | B2 * | 12/2011 | Liu | 315/185 R |
| 2008/0048573 | A1 * | 2/2008 | Ferentz et al. | 315/193 |
| 2009/0128045 | A1 * | 5/2009 | Szczeszynski et al. | 315/185 R |
| 2010/0033110 | A1 * | 2/2010 | Chien | 315/294 |

* cited by examiner

*Primary Examiner* — Tung X Le
(74) *Attorney, Agent, or Firm* — Tung & Associates

(57) ABSTRACT

The present invention discloses a light emitting device array controller which controls a power stage to supply an output voltage to one end of each of a plurality of light emitting device strings. The other end of each of the light emitting device strings is coupled to a corresponding transistor having a current inflow end, a current outflow end and a control end. The present invention obtains signals from the control ends of the transistors instead of the current inflow ends, and feedback controls the output voltage according to the highest voltage of the control ends. Thus, the number of pins required for a circuit chip is reduced.

7 Claims, 8 Drawing Sheets

Regulating critical channel gate voltage such that Vg=Vref
Vout0 is the minimum Vout value which satisfies both Id=I(LED), and Vg of the critical channel in normal operation.

LIGHT EMITTING DEVICE DRIVER CIRCUIT, LIGHT EMITTING DEVICE ARRAY CONTROLLER AND CONTROL METHOD THEREOF

CROSS REFERENCE

The present invention claims priority to U.S. provisional application No. 61/183,366, filed on Jun. 2, 2009.

BACKGROUND OF THE INVENTION

1. Field of Invention

The present invention relates to a light emitting device driver circuit, a light emitting device array controller, and a light emitting device array control method; particularly, it relates to a light emitting device array controller and a control method with less number of chip pins, which do not reduce power utilization efficiency, and a light emitting device driver circuit using the light emitting device array controller.

2. Description of Related Art

One form of light emitting device which is commonly used nowadays is light emitting diode (LED). In large-size applications, LEDs are often arranged in an array, as a light source to provide backlight. As shown in FIG. 1, for controlling and supplying power to an LED array 40, an LED array controller 10 is required in an LED driver circuit, which controls a power supply stage 60 to provide a constant current to every LED string in the LED array 40. The LED array controller 10 is usually an integrated circuit (IC) chip.

More specifically, as shown in FIG. 1, the power supply stage 60 is controlled by the LED array controller 10 to convert an input voltage Vin to an output voltage Vout which is provided to the LED array 40. The LED array 90 includes multiple LED strings CH1-CHn, and every LED string has multiple LEDs connected in series. One end of each of the LED strings CH1-CHn is commonly coupled to the power supply stage 60, and the other end of each of the LED strings CH1-CHn is coupled to one end of a corresponding current source. Each current source controls the current through a corresponding LED string, such that the LEDs emit light uniformly.

In many nowadays applications, the LED array controller 10 is required to drive high power LEDs operating under power such as 1 W to 3 W and current such as 300 mA to 1 A. In such high power application, due to heat dissipation and cost issues of a large-sized chip, transistors of the current sources can not be integrated into the chip but have to be located externally, as shown in FIG. 1. In this case, if the transistors of the current sources are metal oxide semiconductor field effect transistors (MOSFET), the LED array controller 10 needs to provide three pins for each LED channel to electrically connect the source, gate, and drain of the external MOSFET respectively, wherein the pins for the source and the gate are required for the basic structure of the current source, and the drain signal must also be transmitted to the inside of the chip, for determining an appropriate output voltage Vout by feedback control.

FIG. 2 shows another prior art circuit, which is different from FIG. 1 in that the transistors of the current sources are PNP bipolar junction transistors (BJT) instead of MOSFETs. Because the location for obtaining the feedback signal is different, in this scheme, the LED array controller 10 only needs to provide two pins for each LED channel. The drawback of this scheme is that the voltage dropout of the current source is relatively large; the voltage dropout between the collector and the emitter of the PNP BJT is larger than 0.8 volts. The power utilization efficiency is relatively low.

In view of the foregoing, the present invention provides a light emitting device driver circuit, a light emitting device array controller and a control method thereof to reduce the number of pins required in an IC chip while maintaining the power utilization efficiency.

SUMMARY OF THE INVENTION

The first objective of the present invention is to provide a light emitting device driver circuit.

The second objective of the present invention is to provide a light emitting device array control circuit.

The third objective of the present invention is to provide a light emitting device array control method.

To achieve the objectives mentioned above, from one perspective, the present invention provides a light emitting device driver circuit for driving a light emitting device array which includes a plurality of light emitting device strings. The light emitting device driver circuit comprises: a power supply stage for supplying an output voltage to the light emitting device strings, wherein one end of each of the light emitting device strings is coupled to the output voltage in common; a corresponding plurality of transistors coupled to the other ends of the light emitting device strings respectively, wherein each transistor is a field effect transistor or an NPN bipolar junction transistor having a current inflow end, a current outflow end, and a control end; a corresponding plurality of resistors coupled to the current outflow ends of the transistors respectively; a power supply stage controller, coupled to the power supply stage for controlling the power supply stage; a corresponding plurality of operational amplifiers for comparing signals obtained from the current outflow ends with a first reference signal respectively, and generating operational amplifier output signals to control the control ends of the corresponding transistors respectively; a highest voltage selection circuit, receiving the operational amplifier output signals, and outputting a highest one among the operational amplifier output signals; and an error amplifier coupled to the highest voltage selection circuit, for comparing the highest signal with a second reference signal and generating an error signal which is inputted to the power supply stage controller to control the power supply stage.

In one preferred embodiment, the light emitting device driver circuit further comprises a plurality of over voltage exclusion circuits for excluding an operational amplifier output signal which is out of a preset range, and outputting an operational amplifier output signal which is not excluded to the highest voltage selection circuit.

From another perspective, the present invention provides a light emitting device array controller. It controls a power supply stage to supply an output voltage to a light emitting device array which includes a plurality of light emitting device strings, wherein one end of each of the light emitting device strings is coupled to the output voltage in common, and the other end of each of the light emitting device strings is coupled to a corresponding transistor which has a current inflow end, a current outflow end and a control end. The light emitting device array controller comprises: a power supply stage controller coupled to the power supply stage for controlling the power supply stage; a plurality of first pins with a quantity at least corresponding to the number of the light emitting device strings, and a plurality of second pins with a quantity at least corresponding to the number of the light emitting device strings, wherein the first pins are for coupling to the control ends of the transistors respectively, and the second pins are for coupling to the current outflow ends of the transistors respectively; a plurality of operational amplifiers with a quantity at least corresponding to the number of the light emitting device strings, for comparing signals obtained from the second pins with a first reference signal and generating operational amplifier output signals respectively, the outputs of the operational amplifiers being coupled to the corresponding first pins; a highest voltage selection circuit, receiving the operational amplifier output signals, and outputting a highest one among the operational amplifier output signals; and an error amplifier coupled to the highest voltage selection circuit for comparing the highest signal with a second reference signal and generating an error signal which is inputted to the power supply stage controller to control the power supply stage.

In one preferred embodiment, the light emitting device array controller further comprises a plurality of over voltage exclusion circuits for excluding an operational amplifier output signal which is out of a preset range, and outputting an operational amplifier output signal which is not excluded to the highest voltage selection circuit.

From another perspective, the present invention provides a light emitting device array control method for controlling a light emitting device array which includes a plurality of light emitting device strings. The light emitting device array control method comprises: providing an output voltage to one end of each of the light emitting device strings; providing a plurality of transistors with a corresponding quantity to the light emitting device strings, coupled to the other ends of the light emitting device strings respectively, wherein the transistor is a field effect transistor or an NPN bipolar junction transistor having a current inflow end, a current outflow end, and a control end; comparing signals obtained from the current outflow ends with a first reference signal to control the control ends of the corresponding transistors respectively; selecting a highest signal from the control ends of at least a number of the transistors; and comparing the highest signal with a second reference signal, and regulating the output voltage accordingly.

The aforementioned light emitting device is, for example but not limited to, a white LED, a color LED, and an organic LED.

The objectives, technical details, features, and effects of the present invention will be better understood with regard to the detailed description of the embodiments below.

DESCRIPTION OF THE PREFERRED EMBODIMENTS

Figure 3A:
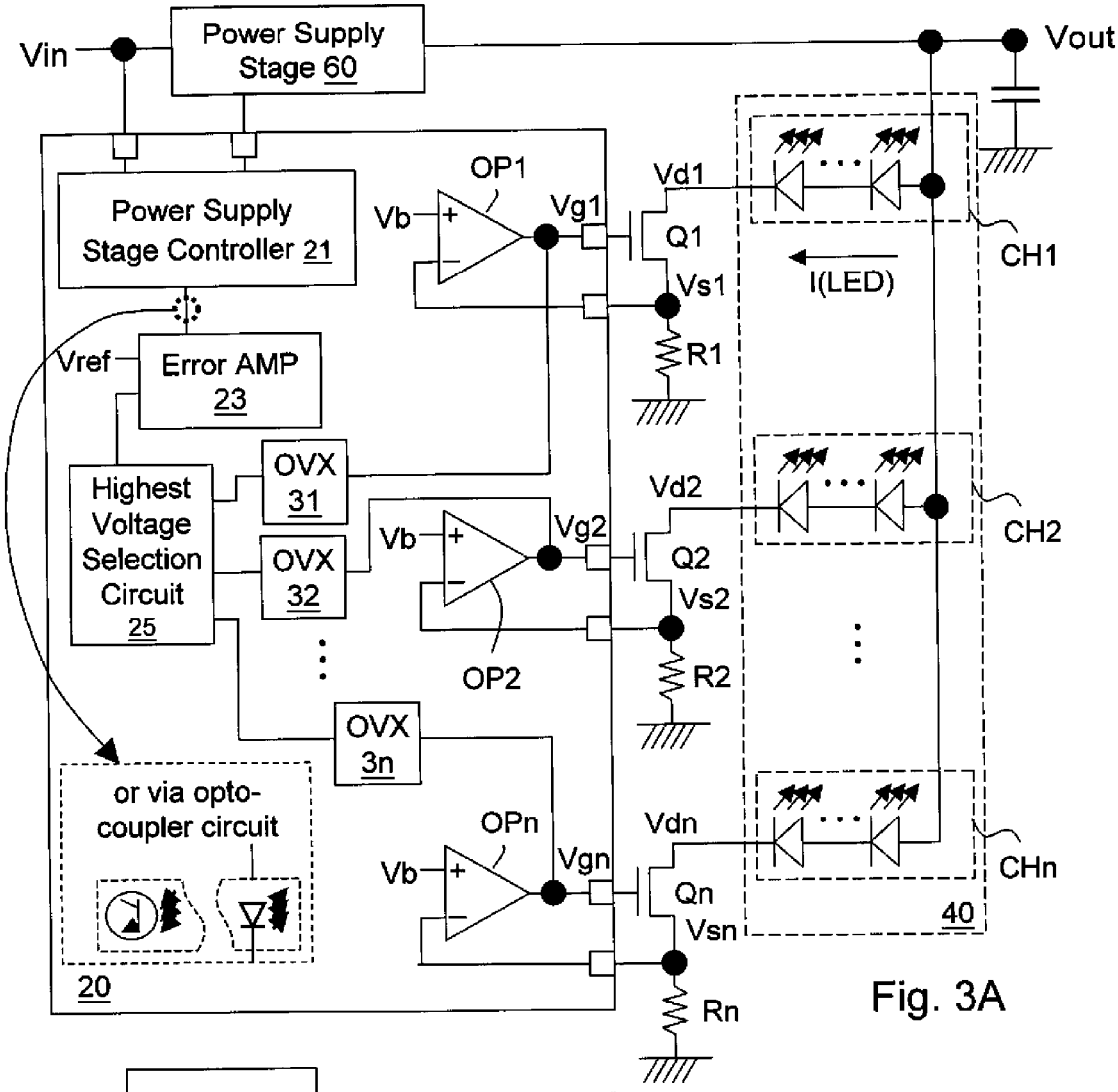
FIG. 3A is a schematic circuit diagram showing a first embodiment of the present invention.

FIG. 3A shows a light emitting device driver circuit of the present invention. Presently, LED is the most common light emitting device, and therefore the description below will use LEDs as examples. As shown in FIG. 3A, a light emitting device driver circuit includes an LED array controller 20 for controlling multiple LED strings CH1-CHn. The LED array controller 20 may be a single IC chip or multiple IC chips plus discrete devices. The LED array controller 20 has a power supply stage controller 21 for controlling power supply stage 60 to convert an input voltage Vin to an output voltage Vout which is provided to an LED array 40. The power supply stage 60 for example may be but not limited to a buck, boost, buck-boost, inverting, or flyback circuit, etc., as shown in FIGS. 4A-4G. The power supply stage controller 21 can control the power supply stage 60 by various ways. For example, the power supply stage controller 21 can receive an error signal from an error amplifier 23, and compare the error signal with a ramp signal, to thereby generate one or multiple pulse width modulation (PWM) signals for controlling one or multiple power transistors in the power supply stage 60 (as shown in FIGS. 4A-4G). What is described above is a PWM control method with a fixed frequency; alternatively, the power supply stage controller 21 can control the power supply stage 60 by pulse frequency modulation (PFM) control method, or other methods. In some applications, the power transistors shown in FIGS. 4A-4G may be integrated to the LED array controller 20. In other applications, the power transistors may be provided outside the LED array controller 20.

Figure 2:
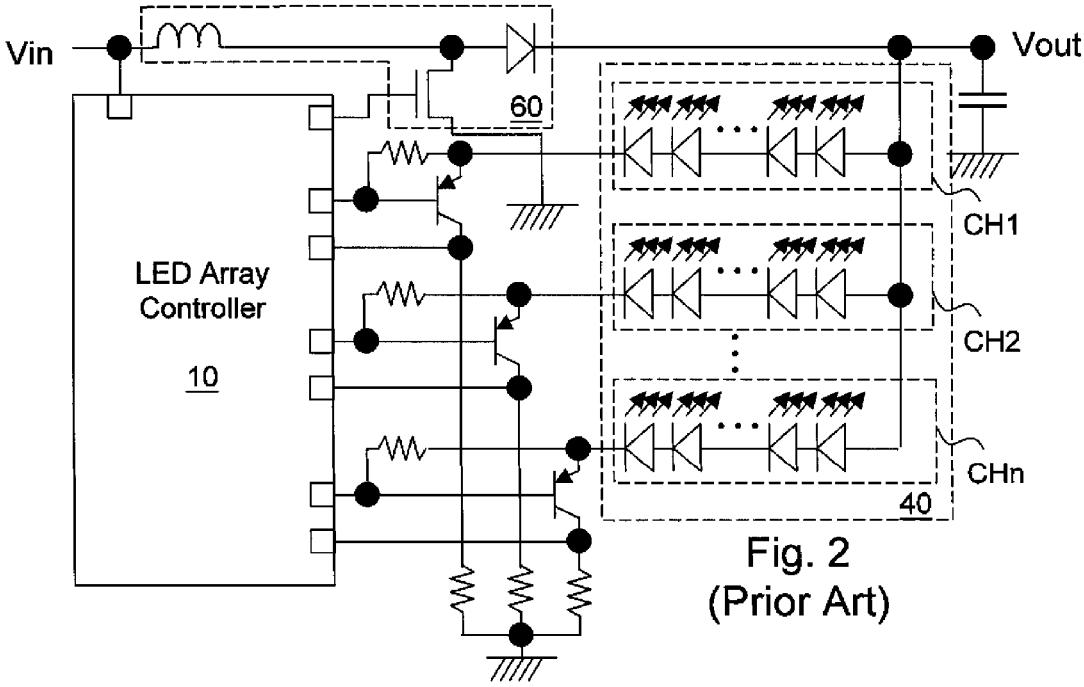
Fig. 2 (Prior Art)
FIG. 2 is a schematic circuit diagram showing another prior art LED controller.

The LED array 40 includes n LED strings, and each LED string has at least one LED. One end of each of the n LED strings is coupled to an output voltage Vout provided by the power supply stage 60, while the other end of each of the n LED strings is coupled to a corresponding current source which provides a stable LED current to the corresponding LED channel. Each current source includes an operational amplifier OP1-OPn inside the IC chip, and an transistor Q1-Qn and a resistor R1-Rn outside the IC chip. In the present invention, the transistors Q1-Qn may be N-type metal oxide semiconductor field effect transistors (NMOSFETs), NPN BJTs, N-type junction FETs (N-JFETs), or other type of FETs. One of the features of the present invention is that, although these type of transistors are used instead of the PNP BJTs shown in the prior art of FIG. 2, only two pins are required for each LED channel in the IC chip; and because PNP BJT is not used, the circuitry has relatively higher power utilization efficiency. As shown in the figure, each LED channel requires only two pins: one pin for controlling the control end of a corresponding transistor and the other pin for obtaining a signal from a current outflow end of the corresponding transistor. (The control end is the gate in case of an N-type FET, as shown in the figure, and the base in case of an NPN BJT; the current outflow end is the source in case of the N-type FET, and the emitter in case of the NPN BJT. In most applications, by connecting a resistor to the base of the NPN BJT and obtaining a voltage from the other end of the resistor, the voltage is functionally equivalent to the FET gate voltage;

the resistor may be located inside or outside the IC chip. Thus, the N-type FET in the present invention may be replaced by an NPN BJT. Because of the above reason, in the description below, only NMOSFET and its gate voltage are described and shown in the figures, but this should by no means be taken as a limitation to the claim scope.)

The current source operates in a way as described below. Taking the LED string CH1 as an example and assuming that the transistor Q1 is an NMOSFET, the LED current I(LED) through the transistor Q1 flows through a resistor R1, and it generates a voltage across the resistor R1, which is the source voltage Vs1. The source voltage Vs1 is used as a feedback signal which is compared with a reference signal Vb by an operational amplifier OP1, and the operational amplifier OP1 controls the gate voltage Vg1 of the transistor Q1 according to the comparison. At the final balanced state, the source voltage Vs1 will be balanced at the level Vb, so the LED Current I(LED) will be regulated to a target value. In other words, each of the current sources forms a local feedback control loop, and the local feedback loop regulates the LED current of a corresponding LED channel to the target value by adaptively regulating the gate voltage Vg1-Vgn. Because all of the operational amplifiers receive the same reference signal Vb, all the LED channels have about the same LED current.

Figure 1:
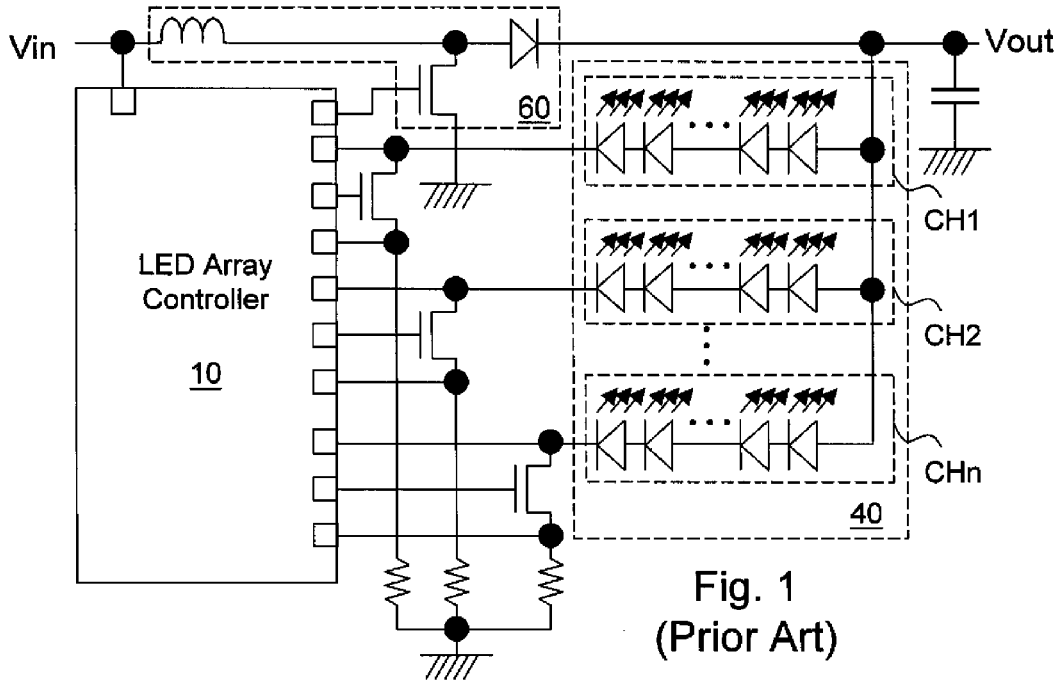
Fig. 1 (Prior Art)
FIG. 1 is a schematic circuit diagram showing a prior art LED controller.

Still referring to FIG. 3A, besides the local feedback control loop for controlling the LED current, the present invention provides a global feedback control loop to regulate the output voltage Vout to an appropriate value, such that the current source of each of the LED channels can operate normally. To this end, unlike the prior art which obtains the feedback signal from the current inflow end of the transistor Q1 (the drain in case of the N-type FET shown in the figure, or the collector in case of the NPN BJT), the present invention obtains the feedback signal from the control end of the transistor Q1. In case of the N-type FET as shown in the figure, the signal is obtained from the gate; in case of the NPN BJT, the signal is obtained from the far end of the base resistor (for simplicity, also referred to as "obtained from the base"). As shown in the figure, because the feedback signal is obtained from the gate, it can be acquired internally inside the IC chip, so the IC chip does not require an additional pin for every channel as in the prior art of FIG. 1.

The operation of the global feedback control loop for regulating the output voltage Vout is described below. A highest voltage selection circuit 25 selects a highest voltage among the gate voltages Vg1-Vgn. The higher the gate voltage is, the larger the difference between the reference signal Vb and the corresponding source voltage is, that is, the lower the current of the corresponding current source is, which means that the voltage across the current source is not high enough to regulate the current to a desired value in normal operation. According to the present invention, selecting the highest voltage among the gate voltages Vg1-Vgn is functionally equivalent to selecting a lowest voltage among the voltages across current sources. The highest voltage is inputted to an error amplifier 23 and compared with a reference voltage Vref to generate an error signal which is provided to the power supply stage controller 21. The transmission of the error signal between the power supply stage controller 21 and the error amplifier 23 may be done directly, or via an opto-coupler circuit. The power supply stage controller 21 controls the power supply stage 60 according to the error signal, to regulate the output voltage Vout and pull up the lowest drain voltage among the current sources. When the highest voltage among the gate voltages Vg1-Vgn is balanced at the reference voltage Vref, it means that all the current sources have entered normal operation condition, and the current of each LED string is under normal control, to be a desired value.

Figure 3B:
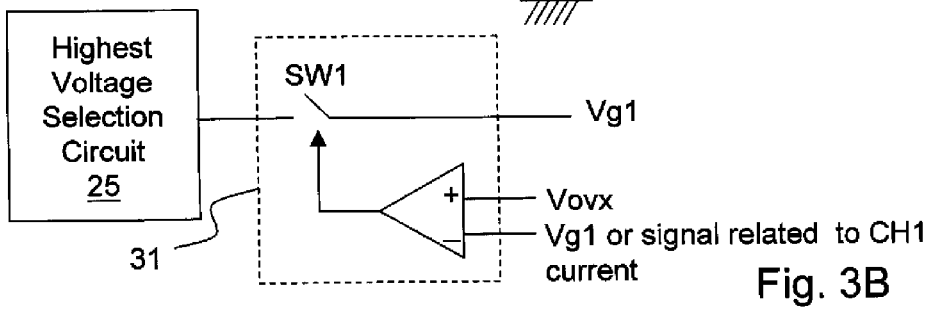
FIG. 3B is a schematic circuit diagram showing an embodiment of an over voltage exclusion circuit.
Figure 4A:
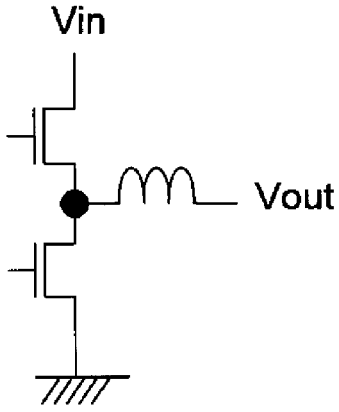
FIGS. 4A-4G are schematic circuit diagrams illustrating examples of several power supply stages.
Figure 4B:
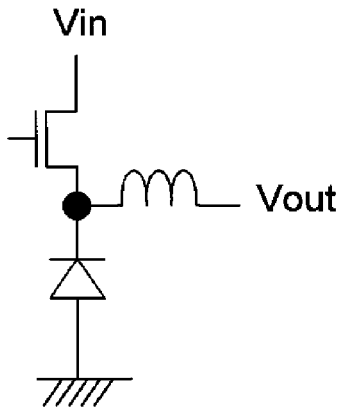
Figure 4C:
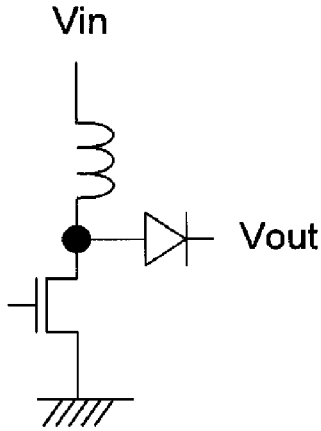
Figure 4D:
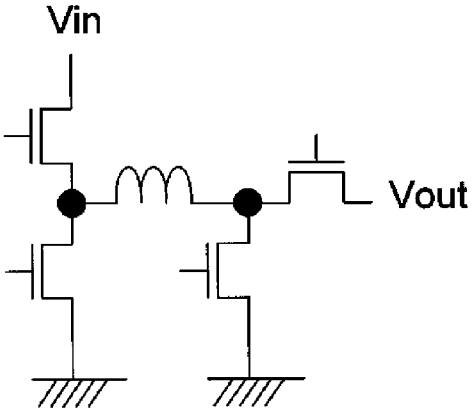
Figure 4E:
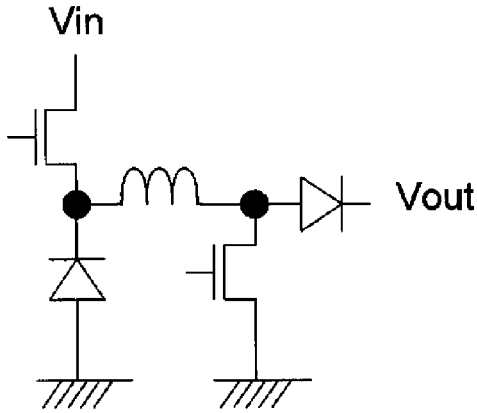
Figure 4F:
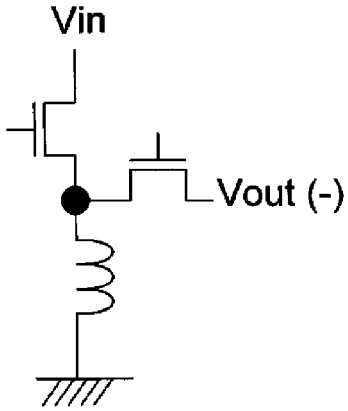
Figure 4G:
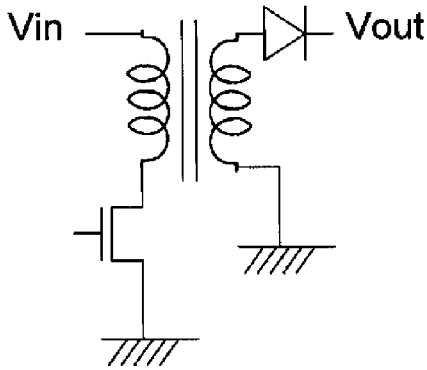

The gate voltages Vg1-Vgn are screened by corresponding over voltage exclusion circuits OVX 31-3*n* respectively. The purpose is to exclude one or more LED channels which are not in use or which operate in abnormal conditions, so as to prevent the global feedback control loop from continuously pulling up the output voltage Vout according to an abnormal gate voltage signal to damage the circuitry or to consume extra power. For example, if the LED channel CH1 is not in use, or the pin which is supposed to be coupled to the source is shorted to ground (the voltage Vs1 is 0), or any LED in the LED string CH1 is damaged such that the LED string CH1 is open-circuited, the difference between the reference signal Vb and the source voltage Vs1 will be too high to cause the gate voltage Vg1, which is the output of the operational amplifier OP1, to be higher than a normal value (i.e., exceeding a preset range). Under this condition, the over voltage exclusion circuit OVX31 will exclude Vg1 from being inputted to the highest voltage selection circuit 25, such that the global feedback control loop feedback controls the output voltage Vout only according to the other normal LED channels. For example, the over voltage exclusion circuit OVX31 may be a circuit shown in FIG. 3B, which compares a signal related to the gate voltage Vg1 or a signal related to the LED channel CH1 current with an exclusion reference voltage Vox. When the comparison result shows that the LED channel CH1 is not in a normal operation condition, the over voltage exclusion circuit OVX31 will turn OFF a switch SW1, such that Vg1 will not be inputted to the highest voltage selection circuit 25. The signal related to the gate voltage Vg1 or the signal related to the LED channel CH1 current may be obtained from the node Vg1 or Vs1. Other embodiments of the over voltage exclusion circuit OVX31 will be described later.

Figure 5:
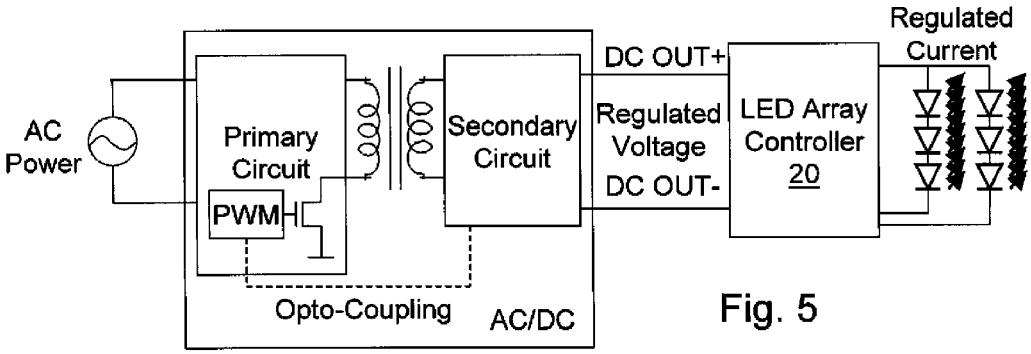
FIGS. 5-7 are three embodiments illustrating examples wherein the input power supply is an AC power supply.
Figure 6:
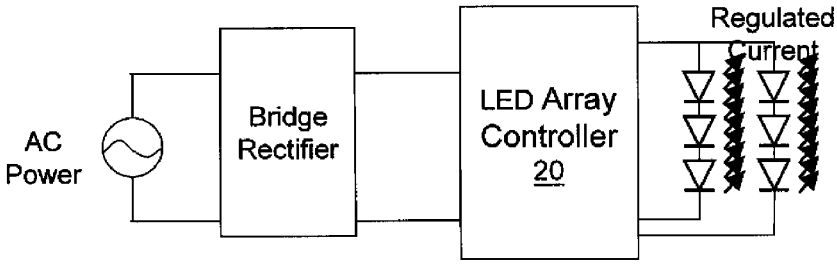
Figure 7:
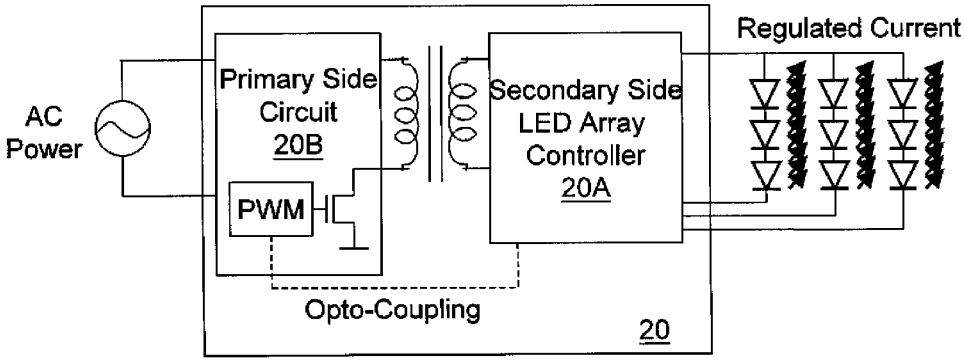

The circuit shown in FIG. 3A can be used as a single stage or a second stage LED controller. "Single stage" LED controller means that the LED controller receives an input voltage Vin directly from a primary power supply, such as from a battery, or from a rectified AC power. "Second stage" LED controller means that the input voltage Vin is a regulated or converted voltage. FIG. 5 shows an example of the two-stage scheme, wherein the LED array controller 20 of the present invention is used as a second stage controller. FIG. 6 shows an example wherein the LED array controller 20 of the present invention is used as a single stage LED controller; the scheme shown in this figure is a non-isolated scheme, wherein the feedback signal is transmitted to the power supply stage controller 21 by electrical wiring. FIG. 7 also shows an example wherein the LED array controller 20 of the present invention is used as a single stage LED controller, but the scheme shown in this figure is an isolated scheme. As shown in this figure, the LED array controller 20 includes two parts: a secondary side LED array controller 20A and a primary side circuit 20B. This scheme requires an opto-coupler for transmitting the error signal from the secondary side LED array controller to a PWM controller in the primary side circuit 20B, such that the PWM controller controls the power switch to regulate the output voltage Vout accordingly. In the aforementioned schemes, the LED array controller 20 may be integrated into one single IC chip, or realized by multiple IC chips; in both cases, the present invention can reduce the number of pins required by the IC chip.

Now we will explain the relationship between the local feedback control loop and the global feedback control loop. The local feedback control loop is for regulating the LED current, and the global feedback control loop is for regulating the output voltage Vout. In the present invention, preferably, the local feedback control loop has a higher response speed (higher bandwidth) as compared to the global feedback control loop. Under such arrangement, and by the present invention, the output voltage Vout can be automatically regulated to a minimum voltage required for each LED channel to operate in a normal operation condition. In other words, the voltage drop of the current source of each LED channel can be maintained at the lowest level, such that the power utilization efficiency is optimized.

Let us first explain how it operates in an LED channel with the highest gate voltage (the critical channel). In an LED channel, the drain-source voltage Vds is equal to the output voltage Vout minus a total voltage drop of all LEDs in the LED string and further minus the source voltage Vs, that is, Vds=Vout−(total voltage drop of the LED string)−Vs wherein Vs is a constant, and, for a specific LED string at a given LED current I(LED) and a given temperature, the total voltage drop of the LED string is also a constant.

Figure 8:
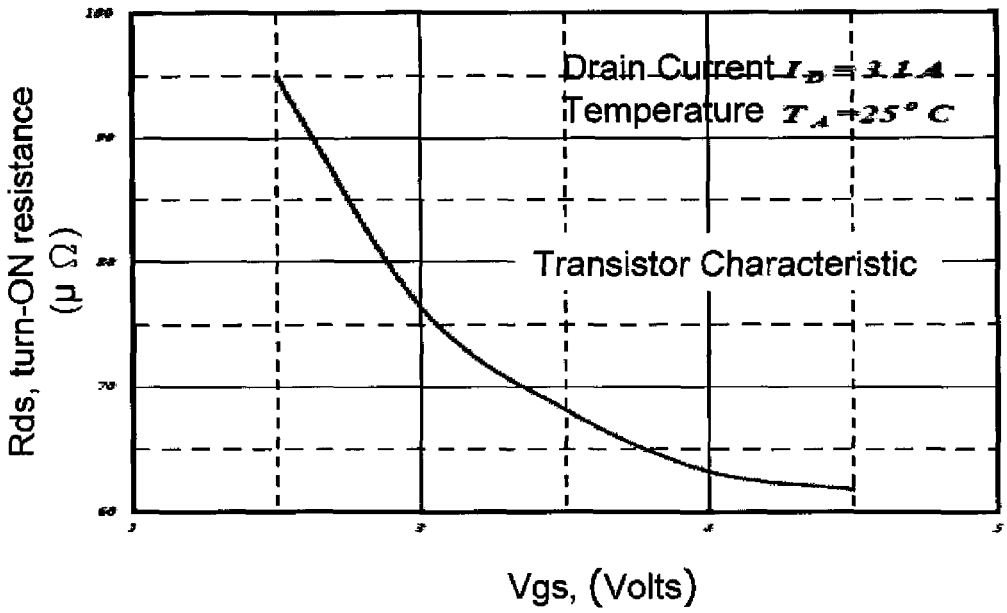
FIG. 8 illustrates a classic characteristics curve of a field effect transistor.
Figure 9:
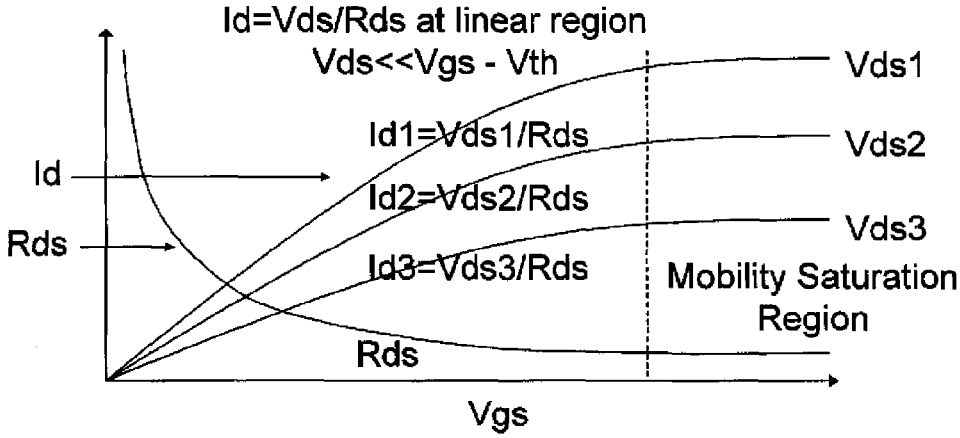
FIG. 9 illustrates relationships among the gate-source voltage, turn-ON resistance, drain-source voltage, and drain current.
Figure 10:
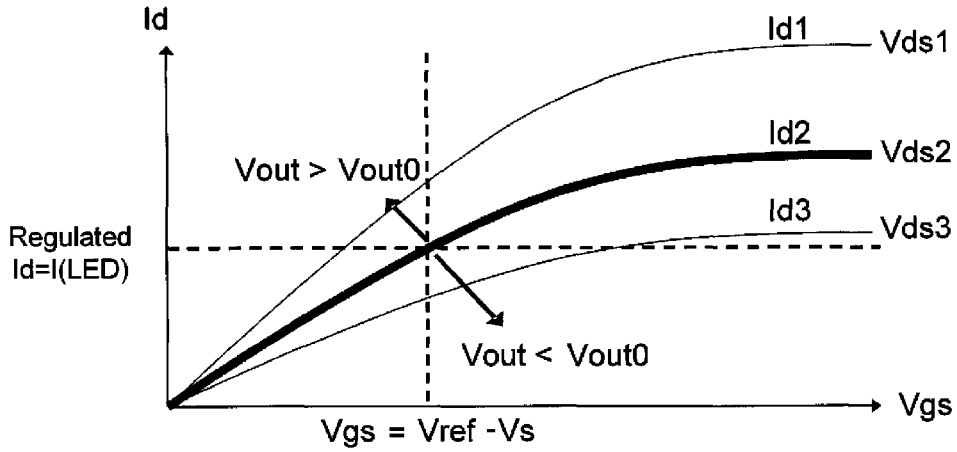
FIG. 10 shows that the targets of local and global feedback control loops are to regulate Id=I(LED) and Vout=Vout0 respectively.

FIG. 8 illustrates a classic characteristics curve of a field effect transistor. FIG. 9 illustrates, with the gate-source voltage Vgs as x-axis, the characteristics curve of the transistor turn-ON resistance Rds and the relationships between different drain-source voltages Vds1-Vds3 and corresponding drain currents Id1-Id3. FIG. 10 shows that the regulation targets of the global and local feedback control loops are Vout-Vout0 and LED channel current Id=I(LED), as indicated by the intersection of the two dashed lines. Vout0 is a minimum voltage for the current source of the critical channel to operate in the normal condition, that is, the minimum voltage to make the gate voltage Vg and the channel current Id of the critical channel both in a normal condition. If the circuit operates at the upper or left part of the thick characteristics curve (labeled with Id2 and Vds2), it indicates that the output voltage Vout is too high and should be decreased. If the circuit operates at the lower or right part of the thick characteristics curve, it indicates that the output voltage Vout is too low and should be increased.

Figure 11:
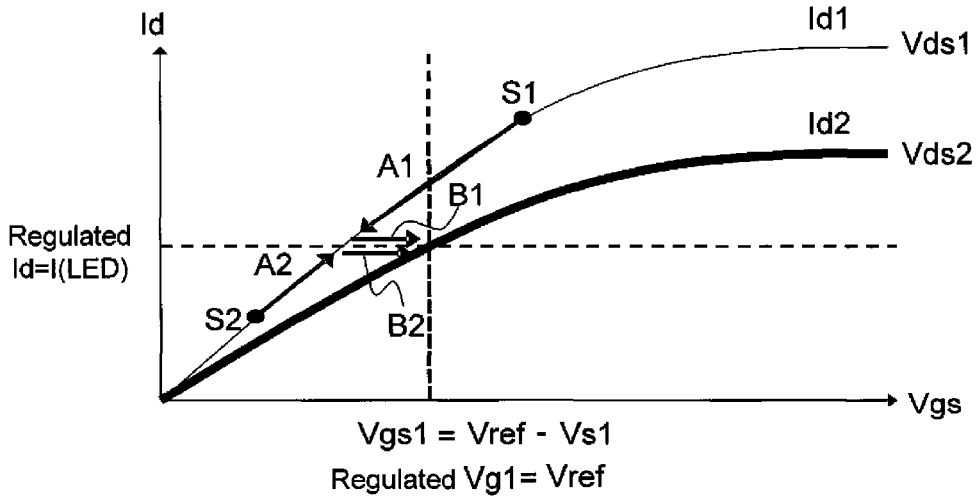
FIGS. 11-13 show regulation processes to targets.

Please refer to FIGS. 3A and 11, and assume that (1) LED channel CH1 is the critical channel, (2) the circuit operates in the condition Vout>Vout0, and (3) the channel current is too high (at the first start point S1) or too low (at the second start point S2). Because the response speed of the local feedback control loop (for regulating the channel current) is higher, the regulation process A1 or A2 will occur first. The local feedback control loop regulates the source voltage Vs1 to Vb, such that I(LED)=Vb/R1, so the channel current is regulated to the target I(LED) first. Then, the global feedback control loop which has a lower response speed compared to the process A1 and the process A2, gradually regulates Vg to Vref (process B1 or B2). In the process B1 or B2, the local feedback control loop still keeps controlling I(LED) at the target Vb/R1, while the gate voltage Vg1 is changed in response to Vout. At last, Vg1 is regulated to the target Vref, and Vout is also regulated to the target Vout0.

Figure 12:
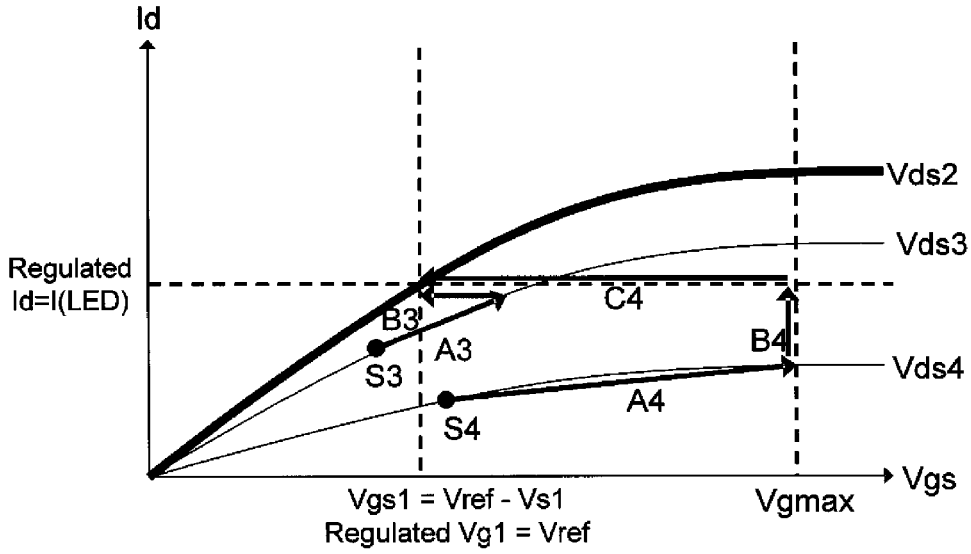

FIG. 12 shows the condition that the circuit operates at Vout<Vout0. Assuming that the circuit starts operation at the third start point S3, because the response speed of the local feedback control loop is higher, the regulation process of the circuit is S3→A3→B3 to the optimized operation point. This process is similar to the aforementioned regulation processes S1→A1→B1 and S2→A2→B2 shown in FIG. 11, but slightest different in that the gate voltage Vg1 at the process A3 will first exceed the reference voltage Vref to compensate the insufficient output voltage Vout such that the channel current Id is regulated to I(LED), and then the gate voltage Vg1 will decrease to Vref when Vout is gradually regulated to Vout0.

FIG. 12 also shows an example where the circuit starts at the fourth start point S4. In this example, it is assumed that the maximum of the output of the operational amplifier OP1 is Vgmax. In the process A4, even though the local feedback control circuit increases the gate voltage Vg1 to the maximum Vgmax, it still cannot regulate the LED channel current to the target I(LED)=Vb/R1, which means that Vout is far below the target Vout0. The local feedback control loop can only keep the gate voltage Vg1 at Vgmax. In the process B4, the global feedback control loop gradually increases Vout to approach Vout0, and finally to a point that the local feedback control loop can effectively regulate Id to Id=I(LED)=Vb/R1 under the condition of Vg=Vgmax. At this point, Vout is still lower than Vout0, so the global feedback control loop is still adjusting Vout (the process C4), and at last, the circuit reaches the optimized operation point: Id=I(LED)=Vb/R1, Vg1=Vref, and Vout=Vout0.

Figure 13:
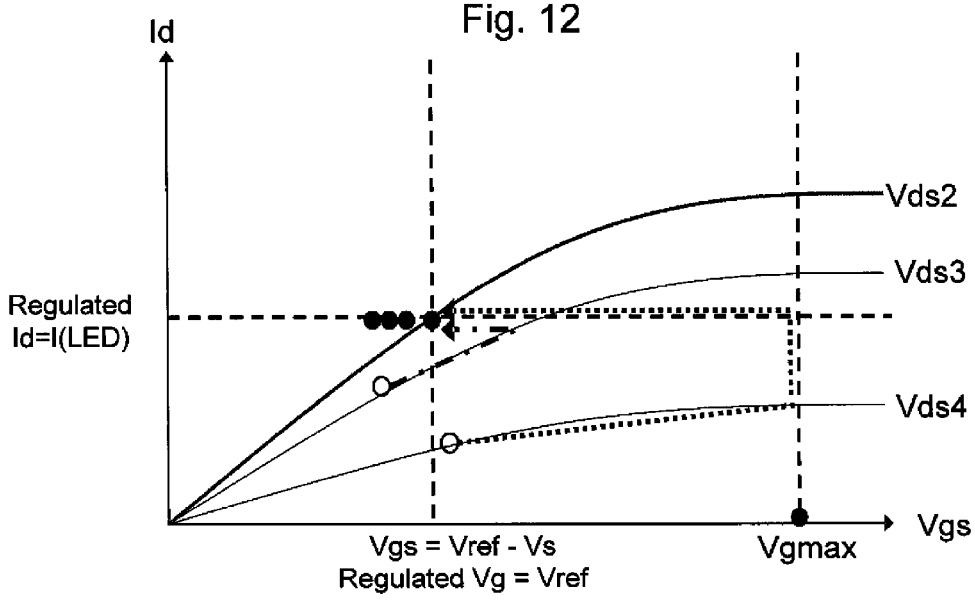

The above description describes how the local feedback control loop and the global feedback control loop of the critical channel operate. Next please refer to FIG. 13 and we will explain the operations of all the LED channels. The highest voltage selection circuit 25 selects the highest voltage (for example, Vg1) among the gate voltages Vg1-Vgn. The global feedback control loop uses the selected Vg1 to regulate Vout, such that the highest voltage Vg1 is balanced at Vref. The LED channel having the highest gate voltage behaves as the aforementioned FIGS. 11 and 12.

The other gate voltages Vg1-Vgn of the other LED channels are lower than the highest voltage Vg1, and therefore, they are lower than Vref. This means that the drain-source voltages of the transistors Q2-Qn will be higher than the drain-source voltage of the transistor Q1, and therefore, it is easier to regulate LED channels CH2-CHn to proper Vg and Vds respectively. When Vout is regulated to the optimized lowest voltage according to the gate voltage Vg1 of the critical channel, every LED channel will have enough current.

Please refer to FIG. 14, again using the first LED channel CH1 as an example. The over voltage exclusion circuit OVX31 may be designed such that: when Vg1 is kept at Vgmax or close to Vgmax (Vgmax−ΔV1 as shown in the figure) for a period of time, and one or more gate voltages Vg2-Vgn of the other LED channels CH2-CHn have reached Vref or have reached a level slightly lower than Vref (Vref−ΔV2~Vref−ΔVn as shown in this figure, wherein ΔV2~ΔVn can be the same or different), the switch SW1 is turned OFF. As such, the gate voltage signal of an abnormal channel can be excluded in a more precise way. The above concept can be embodied in various ways, for example by comparators 141-14*n* and a logic circuit 150 (including logic gates 151 and 152) as shown in the figure.

Figure 14:
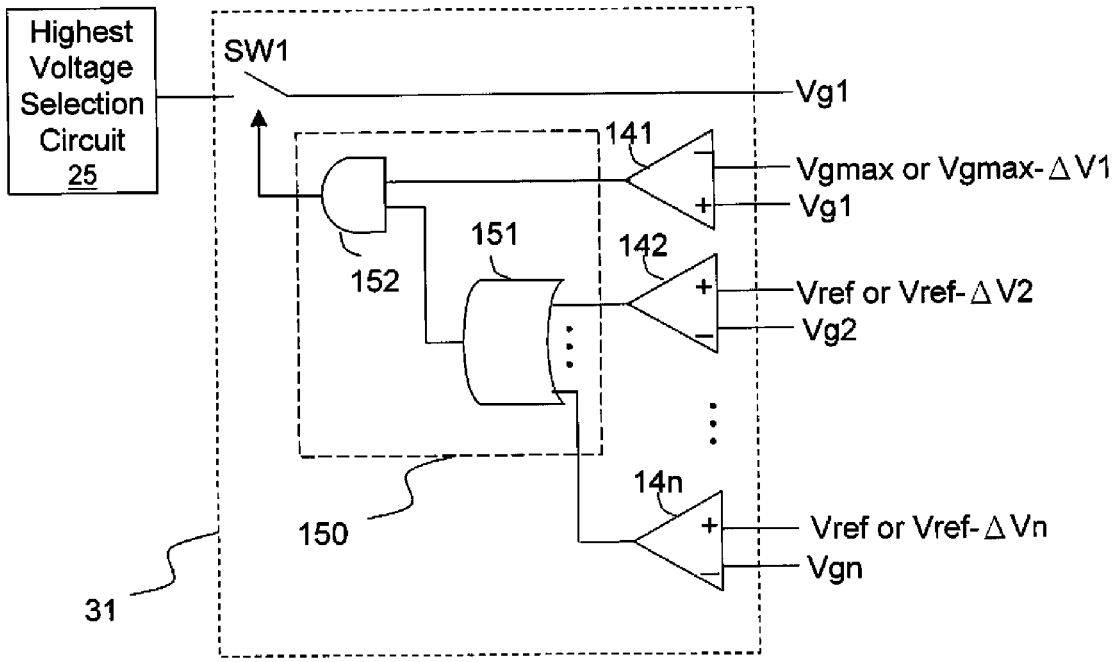
FIG. 14 is a schematic circuit diagram showing another embodiment of an over voltage exclusion circuit.

More specifically, in FIG. 14, the switch SW1 is ON when the AND gate 152 outputs low. If the gate voltage Vg1 is lower than Vgmax or Vgmax−ΔV1, it means that the LED channel CH1 is operating normally, and the AND gate 152 outputs low so that the switch SW1 is ON. If the gate voltage Vg1 is higher than or equal to Vgmax or Vgmax−ΔV1 and all of the gate voltages Vg2-Vgn are higher than or equal to Vref (or Vref−ΔV2~Vref−ΔVn), it means that this is at the start-up stage because all the LED channels are operating under low output voltage, and the AND gate 152 outputs low so that the switch SW1 is ON. If the gate voltage Vg1 is higher than or equal to Vgmax or Vgmax−ΔV1 and at least one of the gate voltages Vg2-Vgn is lower than or equal to Vref (or Vref−ΔV2~Vref−ΔVn), it means that the output voltage is normal but the gate voltage Vg1 is abnormal, and the AND gate 152 outputs high so as to exclude the gate voltage Vg1 not to be an input to the highest voltage selection circuit 25.

In FIG. 14, it is arranged such that the OR gate 151 will output a high level signal as long as one of the gate voltages Vg2-Vgn is lower than or equal to Vref (or a level slightly lower than Vref). It can also be changed such that: it requires two or more of the gate voltages Vg2-Vgn to be lower than or equal to Vref (or a level slightly lower than Vref) for the OR gate 151 to output a high level signal. In this case, the logic circuit 150 will be a more complicated circuit.

In the above embodiments, the reference voltage Vref is preferably set to a voltage high enough such that the transistor of the current source operates in a deep linear region when the channel current Id=I(LED)=Vb/R. Furthermore, Vref is preferably set lower than the mobility saturation region of a field effect transistor to avoid unstable operations of the feedback control loops.

Under the aforementioned arrangement, the highest voltage selection circuit 25 serves to decide the optimized lowest voltage of the output voltage Vout which satisfies the requirements of all the channels, even though there are differences of voltage drops among the LED strings. By the same mechanism, the highest voltage selection circuit 25 can also cope with the differences between the parameters of the transistors of the current sources.

The gains of the operational amplifiers OP1-OPn are preferably high enough such that the LED channels can be regulated to the target current I(LED) with higher precision and better matching.

The present invention has been described in considerable detail with reference to certain preferred embodiments thereof. It should be understood that the description is for illustrative purpose, not for limiting the scope of the present invention. Those skilled in this art can readily conceive variations and modifications within the spirit of the present invention. For example, a circuit or device which does not substantially influence the primary function can be inserted between any two circuits or two devices connected directly in the shown embodiments; the LED referred to in the description should mean to include all kinds of light emitting diodes, such as white LED, color LED, and organic LED, etc. In view of the foregoing, the spirit of the present invention should cover all such and other modifications and variations, which should be interpreted to fall within the scope of the following claims and their equivalents.

What is claimed is:

1. A light emitting device driver circuit for driving a light emitting device array which includes a plurality of light emitting device strings, the light emitting device driver circuit comprising:

a power supply stage for supplying an output voltage to the light emitting device strings, wherein one end of each of the light emitting device strings is coupled to the output voltage in common;

a corresponding plurality of transistors coupled to the other ends of the light emitting device strings respectively, wherein each transistor is a field effect transistor or an NPN bipolar junction transistor having a current inflow end, a current outflow end, and a control end;

a corresponding plurality of resistors coupled to the current outflow ends of the transistors respectively;

a power supply stage controller, coupled to the power supply stage for controlling the power supply stage;

a corresponding plurality of operational amplifiers for comparing signals obtained from the current outflow ends with a first reference signal respectively, and generating operational amplifier output signals to control the control ends of the corresponding transistors respectively;

a highest voltage selection circuit, receiving the operational amplifier output signals, and outputting a highest one among the operational amplifier output signals;

an error amplifier coupled to the highest voltage selection circuit, for comparing the highest signal with a second reference signal and generating an error signal which is inputted to the power supply stage controller to control the power supply stage; and a plurality of over voltage exclusion circuits, coupled to output terminals of the corresponding operational amplifiers respectively, for excluding an operational amplifier output signal which is out of a preset range, and outputting an operational amplifier output signal which is not excluded to the highest voltage selection circuit.

2. The driver circuit of claim 1, wherein each of the over voltage exclusion circuits includes:

a comparator for comparing a signal related to a voltage of the control end of the corresponding transistor or a signal related to the current through the corresponding transistor with a third reference signal to determine whether to transmit the corresponding operational amplifier output signal to the highest voltage selection circuit.

3. The driver circuit of claim 1, wherein each of the over voltage exclusion circuits includes:

a first comparator for comparing a signal related to a voltage of the control end of the corresponding transistor with a reference signal representing a maximum;

a plurality of second comparators, each for comparing a signal related to a voltage of the control end of another transistor with a second reference signal or the second reference signal minus a difference; and a logic circuit for determining whether to transmit the corresponding operational amplifier output signal to the highest voltage selection circuit.

4. The driver circuit of claim 1, wherein each operational amplifier and the corresponding transistor form a local feedback control loop, and the power supply stage, the light emitting device array, the highest voltage selection circuit, the error amplifier, and the power supply stage controller form a global feedback control loop; wherein the response speed of the local feedback control loop is higher than the response speed of the global feedback control loop.

5. A light emitting device array controller, controlling a power supply stage to supply an output voltage to a light emitting device array which includes a plurality of light emitting device strings, one end of each of the light emitting device strings being coupled to the output voltage in common, and the other end of each of the light emitting device strings being coupled to a corresponding transistor having a current inflow end, a current outflow end and a control end, the light emitting device array controller comprising:

power supply stage controller cow led to the power supply stage for controlling the power supply stage;

a plurality of first pins with a quantity at least corresponding to the number of the light emitting device strings, and a plurality of second pins with a quantity at least corresponding to the number of the light emitting device strings, wherein the first pins are for coupling to the control ends of the transistors respectively, and the second pins are for coupling to the current outflow ends of the transistors respectively;

a plurality of operational amplifiers with a quantity at least corresponding to the number of the light emitting device strings, for comparing signals obtained from the second pins with a first reference signal and generating operational amplifier output signals respectively, the outputs of the operational amplifiers being coupled to the corresponding first pins;

a highest voltage selection circuit, receiving the operational amplifier output signals, and outputting a highest one among the operational amplifier output signals;

an error amplifier coupled to the highest voltage selection circuit for comparing the highest signal with a second reference signal and generating an error signal which is inputted to the power supply stage controller to control the power supply stage; and a plurality of over voltage exclusion circuits, coupled to output terminals of the corresponding operational amplifiers respectively, for excluding an operational amplifier output signal which is out of a preset range, and outputting an operational amplifier output signal which is not excluded to the highest voltage selection circuit.

6. The controller of claim 5, wherein each of the over voltage exclusion circuits includes:

a comparator for comparing a signal related to a voltage of the control end of the corresponding transistor or a signal related to the current through the corresponding transistor with a third reference signal to determine whether to transmit the corresponding operational amplifier output signal to the highest voltage selection circuit.

7. The controller of claim 5, wherein each of the over voltage exclusion circuits includes:

a first comparator for comparing a signal related to a voltage of the control end of the corresponding transistor with a reference signal representing a maximum;

a plurality of second comparators, each for comparing a signal related to a voltage of the control end of another transistor with a second reference signal or the second reference signal minus a difference; and a logic circuit for determining whether to transmit the corresponding operational amplifier output signal to the highest voltage selection circuit.

* * * * *